United States Patent [19]

Mitro

[11] 4,159,010

[45] Jun. 26, 1979

[54] LIFTING VEST

[76] Inventor: Tebor Mitro, 750 Littlehill St., London, Ontario, Canada

[21] Appl. No.: 858,201

[22] Filed: Dec. 7, 1977

[51] Int. Cl.[2] ..... A62B 35/00

[52] U.S. Cl. ..... 119/96; 128/133

[58] Field of Search ..... 119/96; 128/133, 134; 272/24; 5/89, 123

[56] References Cited

U.S. PATENT DOCUMENTS

| | | | |
|---|---|---|---|
| 3,424,134 | 1/1969 | Rosenblum | 119/96 |
| 4,026,245 | 5/1977 | Arthur | 119/96 |

*Primary Examiner*—Hugh R. Chamblee

*Attorney, Agent, or Firm*—Irvin A. Lavine

[57] ABSTRACT

A unique garment which may be worn intermittently or continuously by paraplegics provides means for readily attaching the garment and the paraplegic to a lifting device in a manner which encumbers only the mid and upper torso, leaving the lower torso unencumbered by the lifting device. The paraplegic may thereby be lifted by the lifting device with the use of the vest onto and off of a water closet as from a wheel chair or other device and because the vest only encumbers the upper and mid torso, and the lower torso is unencumbered, the lower garments may be easily removed and put on while the paraplegic hangs by his vest.

10 Claims, 6 Drawing Figures

LIFTING VEST

This invention relates to a lifting vest.

More particularly, this invention relates to a garment to be worn over the torso, by paraplegics, so that by means of the garment they may be easily lifted and moved by a simple lifting device which attaches to the garment, such as a cradle bar of a crane.

Paraplegics who have loss motor function of their lower limbs, and who have insufficient strength in their arms by which they themselves may manhandle their bodies from place to place as where a wheelchair is impractical, need the assistance of other people to accomplish the task. It becomes particularly embarrassing when the paraplegic needs assistance to mount a water closet so as to accomplish evacuation.

For children who are paraplegics and who attend, for example a common school, attendants must be available to assit children mounting the water closet. This is impractical, costly and cumbersome, particularly when there are eight or more students in a class.

I have conceived of a unique garment which may be worn intermittingly or continuously by paraplegics. It provides means for readily attaching the garment and hence the paraplegic to a lifting device. The paraplegic may thereby be lifted by the lifting device via the vest, for example onto and off a water closet from a wheelchair or other device, either with the aid of a single attendant, as when the paraplegics mobility of the upper limbs is impaired, or, otherwise alone. Since the vest circumscribes only the upper and mid torso, the lower torso including posterior is free of encumbrance of the lifting vest. It is therefore easy, while the person hangs by the vest, to remove the lower garment (pants) and to expose the posterior and then to mount the paraplegic on a water closet for evacuation.

In its rudimentary form, the garment is a vest which has fabric foundation and means for securing the vest about the mid and upper torso of the wearer such that the garment will be continuously worn in a "buttoned-up" fashion. To the fabric a lattice network of strands or cords is affixed which terminate, exterior to the fabric, above each shoulder as two lifting members. Pulling on the lifting members effectively collapses the lattice in the same fashion as a "Chinese trap" and the wearer is thereby easily lifted without injury or pain.

Particularly, the lattice is a network of strands or cords arranged into two co-operating streams and held in that relationship by the fabric. Each end of each stream terminates with the other end of the other stream as a juncture to form a lifting member exterior to the fabric, above each shoulder.

When the lifting members are pulled, each of the strands are pulled in opposite directions from both their ends simultaneously, and the lattice network tightens about the wearer. Lifting then occurs.

Particularly, the invention achieves a garment for wearing about the mid and upper torso, the garment capable of lifting a person and having arm holes through which the arms of the wearer extend, a fabric foundation and a waist band that is attached continuously at front, side and rear regions to the fabric, the garment comprising:

(a) a plurality of strands attached to the fabric and arranged into a lattice network of two interrelated and co-operating streams, each stream terminating with the other at, (b) a lifting member positioned near the upper portion of each shoulder region of the garment;

(c) each strand of each stream positioned and arranged to extend generally from one lifting member down from the shoulder region across the front of the garment toward the front centre, thence reversibly turning downward toward and interlinking with the waist band along the side region of the garment, and thence upward extending across the back of the garment toward the opposited shoulder to terminate with the other lifting member; and, (d) means front-centre to interlink each strand of one stream to its correspondingly positioned strand of the other stream, whereby pulling on the lifting members tightens the strands and collapses the lattice network and hence places the garment into a tight relation over the upper and mid torso, whereby the wearer may be lifted.

The invention will now be described by way of example and reference to the accompanying drawings in which.

Figure 2:
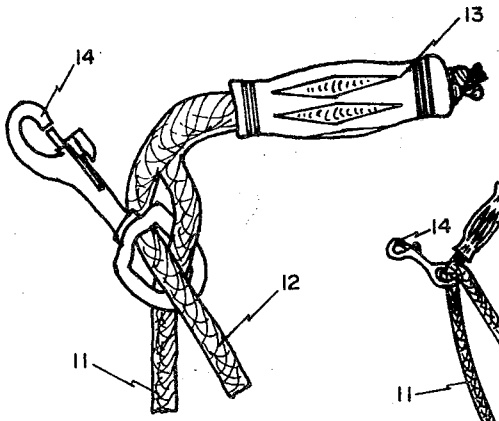
FIG. 2 is an exploded fragmentary view of the means by which the ends of each strand of one stream is interlinked and connected with corresponding ends of the other stream, and its lifting member.
Figure 1:
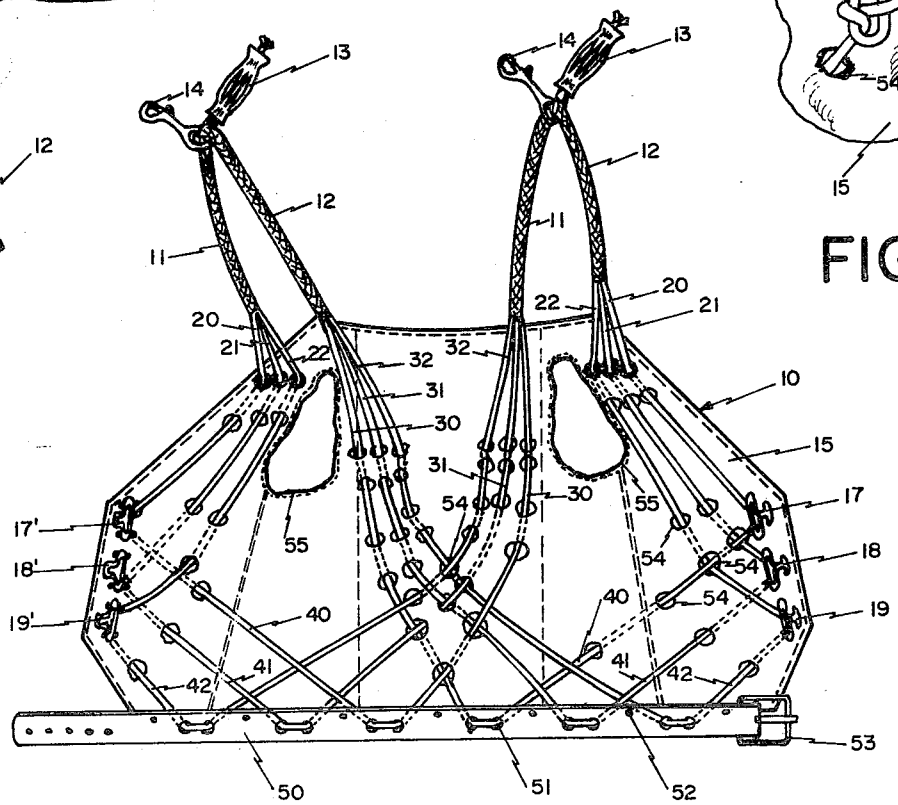
FIG. 1 is a plan view of the garment.
Figure 5:
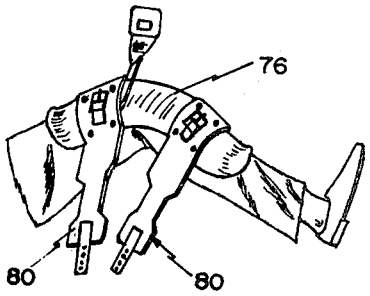
FIG. 5 is a fragmentary perspective of the knee holder positioned but not buckled up.
Figure 6:
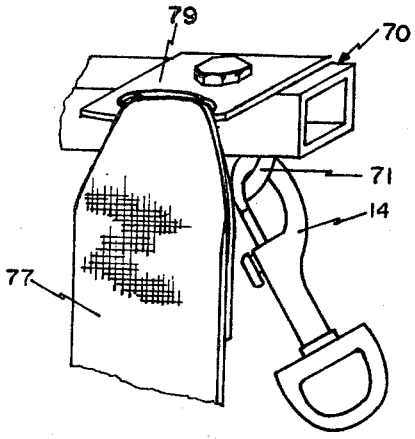
FIG. 6 is an exploded perspective detailing the connection means with the cradle.

Referring to FIG. 1 the garment 10 is composed of a fabric 15 which defines two armholes 55. A waistband 50 in the form of a belt with a buckle 53 through which the end of the belt may lace, has the plurality of apertures spacely arranged on the belt through which the strands of each network stream may pass. The garment may be "buttoned-up" by respective male and female connectors 17, 17', 18, 18', 19 and 19' as clearly seen in FIG. 2.

Each of the network streams is a mirror of the other and is composed of a plurality of strands. In this embodiment, each stream is formed by three continuous strands which respectively commence as strand segments, 20, 21 and 22 from a common braid 11, thence, respectively interlace through male segments 17, 18 and 19 of each of the buckle connectors. Thence, the strands extend as segments 40, 41 and 42 from the male segments and connect at spacially arranged locations along the waistband 50 in the vicinity of the side of the garment, thence upward, from the waistband, as segments, 30, 31 and 32 across the back of the garment to the opposite shoulder to extend out of the fabric out of the left rear shoulder region of the garment into common braid 12. The other stream commences from the common braid 12 and terminates at the common braid 11 and is a mirror of the first except it interlaces with female segments 17', 18' and 19'. Each of the common braids is a commencement and terminating braid for each stream of the network and they respectively interbraid with a snap connectors 14 and dressingly terminate at a handle 13.

Figure 4:
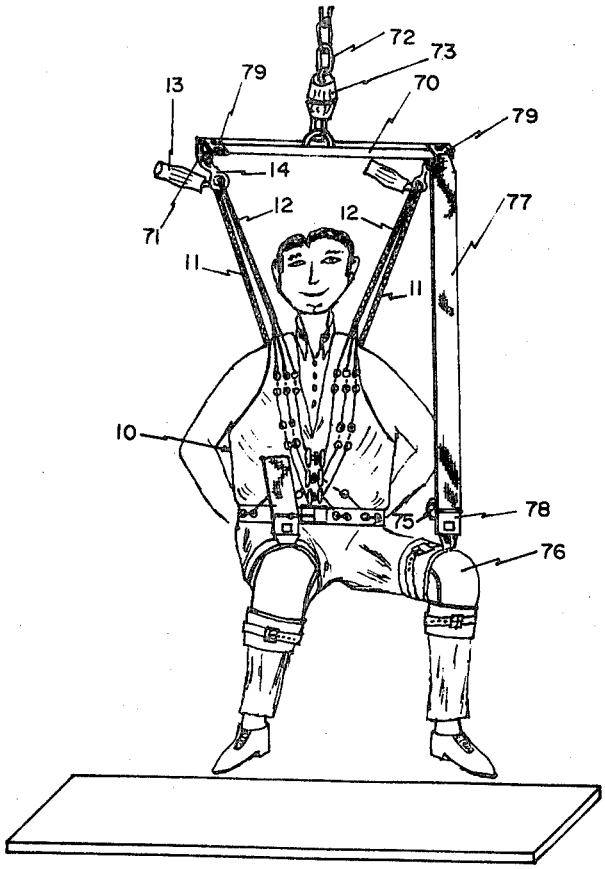
FIG. 4 is a front perspective of the vest in use with aid of knee holders with the right knee carrying strap, omitted for clarity.

The garment must be worn by the wearer in a "buttoned-up" fashion (FIG. 4) and hence each male connector interlocks with its female counterpart. A belt 50 is affixed to the fabric 15 as the waist band of the garment by a plurality of rivets 52. The waistband is laced up by securing the free end of the belt 50 through its buckle 53. This constrains the lower portion of the vest about the wearer above the hips and insures therefore, that each strand is located on the body so that comfortable lifting is achieved.

The wearer may be lifted via the lifting vest 10 with the aid of the cradle bar 70 of a lifting device (not shown). The cradle bar 70 includes at its extremities eyelets 71 into which respectively engage snap connectors 14. A central swivel 73, is located at the centre of the cradle 70 and a cable or chain 72 extends between the swivel 73 and a winch or crane (not shown). The winch preferably is electrically operated and reversible so that the relative position vis-a-vis the ground of the cradle 70 and hence of wearer may be regulated. By means of the handle grips 13 the paraplegic when suspended by the cradle bar 70 may be rotated, by the swivel 73. This assists in positioning the paraplegic as required for removing the lower garments, trousers and the like, prior to and subsequent to evacuation etc.

Once the paraplegic is lifted by the cradle bar, since the vest encumbers only the upper and mid portions of the torso, and not the lower torso, the lower garments are free to be easily removed to expose the privates of the paraplegic.

When the paraplegic has extremely limited movement, it may be necessary to provide a comfortable posture for evacuation. Thus means are provided for the legs of the wearer to be placed relative to the mid and upper torso, in a position akin to sitting. This is achieved by a knee holder 76, detachably affixed to extending straps 77 as through a seat belt like clasp 78. The straps 77 on the other hand are attached to the extremities of the cradle 70 through the eyelet 79. Each strap, by virtue of the seat belt connector extends into a pull pigtail 75. By pulling the pigtail 75 the relative length of the straps 77 between eyelet 79 and its connector 78 may be regulated and hence the relative position of the lower limbs vis-a-vis the torso adjusted. The knee of each leg is held in the knee holder 76 by an upper and lower strap and buckle combination or arrangement 80. The knee holder may be affixed over the trousers of the paraplegic (FIG. 4) so that the paraplegic may be conveyed from one position to another, or, when evacuation is necessary, after the trousers have been removed.

Figure 3:
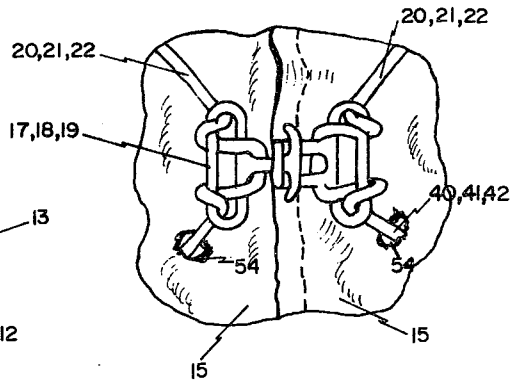
FIG. 3 is an exploded fragmentary view of a strand connected to a male and female front-centre connector.

In the embodiment that I prefer, for people of normal weight, there are six continuous strands or cords, three strands belonging to each stream. One strand is composed of segments 20-40-30, the second strand of segments 21-41-31, and the third 22-42-32. The various segments 20, 21, 22; 30, 31, 32; 40, 41, 42; of each of the strands of the network are held in their relative positions vis-a-vis the fabric 15 by means of their respective interlacing at strategic locations with the fabric as by passing through eyelets 54, located in the fabric. The eyelets, may be metal rings or otherwise reinforced similar to buttonhole stitching. This is a convenient means of constraining the strands of each stream relative to the fabric while allowing free strand movement relative to the fabric. Other means are also possible as by stitching the strands directly to the fabric (but this inhibits relative movement of the strands with the fabric). I prefer to use a system of eyelets incorporated into the fabric with the strands extending through eyelets and interweaving with the fabric. The interweaving of the respective strands with respect to the fabric allows free movement of the strands relative to the fabric and hence a more comfortable "closing" and tightening of the vest is assured when the wearer is lifted by the cradle. This arrangement also permits relative adjustment of the length of the strands and in particular of the relative length of the segments 40, 41 and 42 and 20, 21 and 22 vis-a-vis the connectors 17, 17', 18, 18', 19 and 19'. This is due to the fact that, referring to FIG. 3, that the segments 20, 21 and 22 interweave with the connector and thence continue as segments 40, 41 and 42. This allows locating the relative position of the connectors along their strands. If the segments, for example 20, 40 and 30 were not segments of a continuous strand but, were in fact individual strands and respectively terminated at the buckle and the belt, relative adjustment of the length of the strand 20, 21 and 22 vis-a-vis those of 40, 41 and 42 would be difficult if not impossible. This would inhibit comfortable adjustment to accommodate various chest profiles of wearers. It is for this reaseon the belt 50 is provided with aperatures 51 through which the stream strands pass. In this way each segment length self adjusts as the buckle connectors are positionally located on the individual strands. This arrangement of a continuous strand having three segments and a buckle which relatively adjusts its position on the strand has advantage in also adjusting the "play" of the networks during initial lifting vis-a-vis the fabric.

In certain applications because of the varying weight of the wearer, the streams may include less than 3 strands each and as many as 5 or more strands.

I have found that a more rugged vest can be achieved if the fabric is, for example a denim; the strands, cords of rope about 3/16 (approximately 1 cm.) in size and the eyelets of reinforced stitching similar to those used for buttonholes. The eyelets tend to reduce the extent of concentration of tension or pull on the fabric in the vicinity of each eyelet and hence inhibit tearing of the fabric; longer vest life is assured.

The vest as disclosed may be the component part of more ornate wearing apparel as for example a jacket. In this application, not shown, the vest 10 is the foundation of the jacket to which is attached on the inside a lining and to the outside a material shell which hides the strands. In this application (not shown) each network must still terminate at a lifting member at the shoulder and the lifting member should extend outside the jacket shell.

The embodiments of an invention in which an exclusive property or privilege as claimed is defined as follows:

1. A garment for wearing about the mid and upper torso, the garment capable of lifting a person and having arm holes through which the arms of the wearer extend, a fabric foundation and a waist band that is attached continuously at front, side and rear regions to the fabric, the garment comprising:

(a) a plurality of strands attached to the fabric and arranged into a lattice network of two interrelated and co-operating streams, each stream terminating with the other at, (b) a lifting member positioned near the upper portion of each shoulder region of the garment;

(c) each strand of each stream positioned and arranged to extend generally from one lifting member down from the shoulder region across the front of the garment toward the front centre, thence reversibly turning downward toward and interlinking with the waist band along the side region of the garment, and thence upward extending across the back of the garment toward the opposite shoulder to terminate with the other lifting member; and, (d) means front-centre to interlink each strand of one stream to its correspondingly positioned strand of the other stream, whereby pulling on the lifting members tightens the strands and collapses the lattice network and hence places the garment into a tight relation over the upper and mid torso, whereby the wearer may be lifted.

2. The garment as claimed in claim 1 wherein each stream of the network is composed of strands arranged into three segments, a first segment extending between one lifting member and the front centre means to interlink each strand of one seam with its correspondingly positioned strand of the other stream, the second segment extending from said front-centre means to the waistband, and the third segment extending from the waistband across the back of the garment to the other lifting member.

3. The garment as claimed in claim 2 wherein each strand is a continuous strand that defines the three segments.

4. The garment as claimed in claim 1, wherein each stream of the network has at least three strands.

5. The garment as claimed in claim 1, wherein the strands interweave between front and obverse sides of the fabric, and the interweaving positionally arranges each strand relative to the fabric.

6. The garment as claimed in claim 1, wherein the fabric defines a plurality of aperatures strategically located over the garment, and through which the strands extend, as they respectively interweave between front and obverse sides of the fabric, such that the aperatures constrain the strands to the garment in a relatively fixed positional relation while allowing relative linear movement of the strands therewith.

7. The garment as claimed in claim 1, wherein the fabric defines a plurality of aperatures strategically located over the garment, and through which the strands extend, as they respectively interweave between front and obverse sides of the fabric, such that the aperatures constrain the strands to the garment in a relatively fixed positional relation while allowing relative linear movement of the strands therewith and each stream is the mirror of the other.

8. The garment as claimed in claim 1, wherein the garment defines a plurality of aperatures strategically located over the garment, and through which the strands extend, as they respectively interweave between front and obverse sides of the fabric, such that the aperatures constrain the strands to the garment in a relatively fixed positioned relation while allowing relative linear movement of the strands therewith.

9. The garment as claimed in claim 1, wherein the garment defines a plurality of aperatures strategically located over the garment, and through which the strands extend, as they respectively interweave between front and obverse sides of the fabric, such that the aperatures constrain the strands to the garment in a relatively fixed positional relation while allowing relative linear movement of the strands therewith and each stream is the mirror of the other.

10. A body lifting mechanism including the garment as claimed in claim 1, comprising;

(a) a cradle bar adapted for attachment to a reversible hoist whereby the cradle bar may be moved relative to the ground;

(b) means for fixing each end of each stream to the opposite ends of the cradle bar whereby the garment is attached to the cradle bar;

(c) a knee holder adapted to engage the underside of the leg of the wearer in the vicinity of the knee;

(d) an adjustable strap means connected between the cradle bar and the knee holder whereby the relative distance between the crade bar and the knee holder may be adjusted and hence relative position of the lower limbs of the person relative to the torso.

* * * * *